US006085737A

United States Patent [19]

Fukada

[11] Patent Number: 6,085,737

[45] Date of Patent: Jul. 11, 2000

[54] LIGHT-WEIGHT PORTABLE COOKING GAS STOVE

[75] Inventor: Satoshi Fukada, Kamihonmachi, Japan

[73] Assignee: Fukadack Co., Ltd., Hyogen-ken, Japan

[21] Appl. No.: 09/093,154

[22] Filed: Jun. 8, 1998

[30] Foreign Application Priority Data

Jun. 17, 1997 [JP] Japan ..... 9-197697
Nov. 7, 1997 [JP] Japan ..... 9-343589

[51] Int. Cl.[7] ..... F24C 3/00

[52] U.S. Cl. ..... 126/41 R; 126/44

[58] Field of Search ..... 126/38, 40, 41 R, 126/44, 50, 39 N

[56] References Cited

U.S. PATENT DOCUMENTS

| | | | |
|---|---|---|---|
| 1,450,870 | 4/1923 | Sanders . | |
| 2,498,682 | 2/1950 | Howard | 126/38 |
| 2,853,126 | 9/1958 | Corlet | 126/38 |
| 2,928,386 | 3/1960 | Keyt et al. | 126/38 |
| 3,139,879 | 7/1964 | Bauer et al. | 126/4 |
| 3,199,573 | 8/1965 | Flynn | 158/116 |
| 3,876,364 | 4/1975 | Hefling | 126/38 |
| 4,588,373 | 5/1986 | Tonon et al. | 431/328 |
| 4,726,350 | 2/1988 | Steinhauser | 126/38 |
| 4,896,652 | 1/1990 | Geiter | 126/41 |
| 5,111,803 | 5/1992 | Barker et al. | 126/41 |

FOREIGN PATENT DOCUMENTS

| | | |
|---|---|---|
| 51-46265 | 4/1976 | Japan . |
| 53-39668 | 4/1978 | Japan . |
| 8-233275 | 9/1996 | Japan . |

*Primary Examiner*—Ira S. Lazarus
*Assistant Examiner*—Sara Clarke

[57] ABSTRACT

A light-weight portable cooking gas stove to be connected to a source of pressurized gas fuel comprises a hollow circular plate, a circular pipe gas cylinder, a gas discharge control, a piezoelectric ignition, a ceramic crater for gas combustion substantially centrally disposed with respect to the plate and a double cover forming a trivet. The cylinder is installed adjacent to an inner circumference on the bottom of the plate to ensure stability of the stove. A filter is disposed within the cylinder to remove dust in the gas fuel. The cylinder includes on its exterior a gas fuel injection entrance. The gas discharge control is provided with a secondary regulator with a gas discharge valve for the gas fuel and an adjustable air intake for combustion in the crater. The gas discharge control may include a vinyl pipe which takes a roundabout path alongside the crater between the air intake and the cylinder to evaporate the gas fuel by waste heat of the crater. The upper double cover prevents dirt from entering the stove from boiling over from a cooker. Systematic geometrical through holes and minimum projections on the side wall of the cylinder make the stove more aesthetic.

14 Claims, 5 Drawing Sheets

LIGHT-WEIGHT PORTABLE COOKING GAS STOVE

BACKGROUND OF THE INVENTION

This invention relates to an improvement for a light-weight portable cooking gas stove disclosed in U.S. patent application Ser. No. 08/890,099 filed by the applicant on Jul. 9, 1997, and which is hereby incorporated by reference. More particularly this invention relates to a portable ceramic cooking gas stove which can more easily control an air intake rate and/or a gas fuel rate for a ceramic crater and can efficiently evaporate gas fuel from the ceramic crater.

A known light-weight portable cooking gas stove, such as disclosed in U.S. patent application Ser. No. 08/890,099, comprises a hollow circular plate forming a main body of the stove, a circular pipe cylinder arranged at an inner circumference of the hollow circular plate having a filter for the pressurized gas fuel inwardly thereof, a gas combustion means including a circular fine porous ceramic crater installed centrally in the hollow circular plate, a gas introducing pipe thereunder connected with a gas releasing valve on an end of the circular pipe gas cylinder and an ignition plug adjacent to the porous ceramic crater connected with a piezoelectric ignition switch projecting from an outside wall of the hollow circular plate to ignite the gas released from the ceramic porous crater.

The gas combustion means for the portable cooking gas stove, however, has not always efficiently burned because of imperfect evaporation of the pressurized gas fuel between a gas entrance of the ceramic porous crater and the circular pipe gas cylinder. In addition, the rate of air into the ceramic porous crater for efficient combustion, cannot be controlled due to a fixed gas releasing nozzle and gas introducing pipe on a right angular conduit support, which connects with the circular pipe gas cylinder and the ceramic porous crater, respectively. In addition, the rustic exterior of the known portable cooking gas stove may be inappropriate for use on a table for a dinner party.

BRIEF SUMMARY OF THE INVENTION

A light-weight portable cooking gas stove comprises a hollow circular plate provided with legs, which forms a main body of the stove. A circular pipe gas cylinder is provided inwardly with a filter such as a foamed plastic or a fabric and is provided on an inner circumference of the hollow circular plate. A gas combustion means installed centrally in the hollow circular plate is provided with a circular fine porous ceramic crater thereon and a gas introducing pipe thereunder which is connected with a gas discharge control portion separated from an end of the circular pipe gas cylinder. An ignition plug adjacent to the porous ceramic crater is electrically connected with a piezoelectric ignition switch projecting from an outside wall of the hollow circular plate to ignite the gas released from the ceramic porous crater.

The circular pipe gas cylinder is provided with a gas injection entrance at a side or an underside at either end to fill up the gas fuel provided from a cassette gas cylinder from outside the hollow circular plate. The gas discharge control means is provided with a gas discharge means projecting from the outside wall of the hollow circular plate, and a gas discharge control means thereon which adjusts slightly gas flow discharged from the circular pipe gas cylinder.

A gas releasing pipe connected with the gas discharge control means provides an adjustable air intake means thereon and connects with the gas introducing pipe for the gas combustion means at another end. The ceramic crater is formed in a shape of circular plate having a great number of holes to increase heat efficiency by infra-red rays emitted during the combustion.

The light-weight portable cooking gas stove is covered with upper double covers to form a trivet to prevent soiling in the interior of the plate in the event of boiling over. The light-weight portable cooking gas stove is ornamented with many systematic geometrical through holes on a side and bottom plate, to reduce weight and provide for easy air circulation.

Accordingly, an embodiment of the invention provides a light-weight portable cooking gas stove which is very stable and clean when used.

An embodiment of the invention provides a light-weight portable cooking gas stove which is able to supply gas fuel from a cassette gas cylinder into a circular pipe gas cylinder from outside of a hollow circular plate.

An embodiment of the invention provides a light-weight portable cooking gas stove which has remarkably improved cooking efficiency because of a central circular ceramic crater and a long fuel gas supply pipe taking a roundabout path alongside or neighboring the ceramic circular ceramic crater.

An embodiment of the invention provides a light-weight portable cooking gas stove which is able to ignite gas and to control gas supply from outside of a hollow circular plate.

An embodiment of the invention provides a light-weight portable cooking gas stove which is able to delicately adjust the gas supply from a circular pipe gas cylinder to a central circular ceramic crater, by operation of a gas discharge control means after a gas discharge means, for more efficient combustion.

An embodiment of the invention provides a light-weight portable cooking gas stove which is able to delicately adjust air volume to be taken into the gas fuel flow to a central ceramic crater, by an air control means on a hole of a gas introducing pipe, for more efficient combustion.

An embodiment of the invention provides a light-weight portable cooking gas stove which has a wide space inside a hollow circular plate, and many systematic geometrical through holes to reduce weight and provide for easy air circulation and is ornamental.

An embodiment of the invention provides a light-weight portable cooking gas stove on which sets upper double covers to form a trivet, to prevent soiling in the stove by boiling over from a cooker and provides a safe place for the cooker.

DETAILED DESCRIPTION OF THE INVENTION

Figure 1:
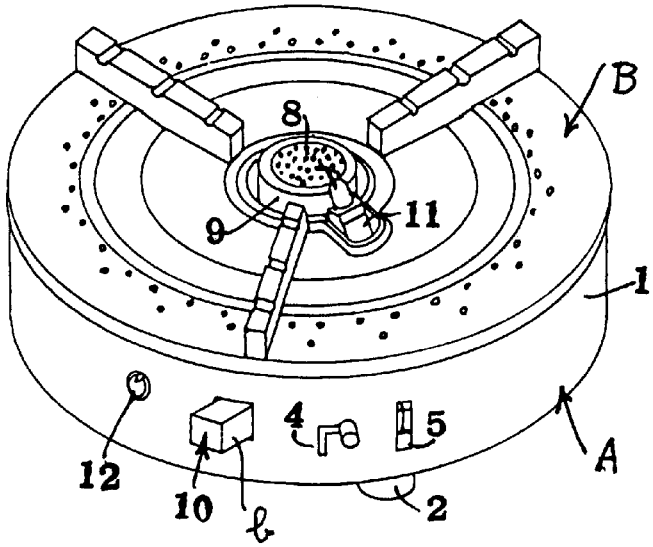
Fig. 1 PRIOR ART
FIG. 1 is perspective view of a known light-weight portable cooking gas stove.
Figure 2:
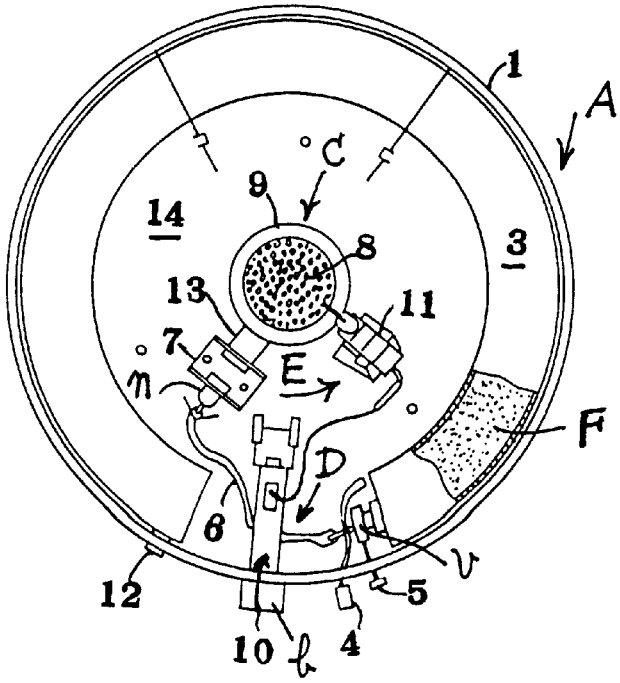
Fig. 2 PRIOR ART
FIG. 2 is a plan view of the portable cooking gas stove of FIG. 1.

FIGS. 1 and 2 show a light-weight portable cooking gas stove A as disclosed in U.S. patent application Ser. No. 08/890,099 comprising a hollow circular plate 1 forming a gas stove body having a plurality of supporting legs 2, a circular pipe gas cylinder 3 provided inwardly with a filter F pressurized gas fuel, a gas fuel discharge control means D connecting with a gas fuel combustion means C and the circular pipe gas cylinder 3, a piezoelectric ignition means E and an upper cover forming a trivet B.

The circular pipe gas cylinder 3 is installed alongside a bottom marginal inner surface of the hollow circular plate 1 and is provided with the filter F covered on its inner surface 12 projecting through the side wall of the hollow circular plate 1.

The gas fuel discharge control means D comprises a gas discharge lever 4 connecting with a gas discharge valve v and a discharge control lever 5, a vinyl pipe 6 and an air intake support 7. The gas discharge control lever 5 with the gas discharge lever 4 respectively projects outwardly through the side wall of the plate 1.

The air intake support 7 is shaped like a short right angular conduit so that a gas releasing nozzle n is connected with the vinyl pipe 6 for gas supply opposite to a gas introducing pipe 13 for the ceramic gas combustion means C. The gas introducing pipe 13 takes air from a gap between the nozzle n and the pipe 13 inserted respectively into side walls of the air intake support 7.

The gas fuel combustion means C is installed centrally in the hollow circular plate 1 and comprises a ceramic circular crater 8 supported on a support ring 9 and connected thereunder to the gas introducing pipe 13 which is inserted into one side of the wall of the air intake support 7. The ceramic circular crater 8 has many exceedingly fine holes to greatly enhance combustion efficiency.

The piezoelectric means E comprises a piezoelectric ignition plug 11 and a piezoelectric ignition switch 10, and the former is arranged adjacent to the ceramic circular crater 8 and electrically connected with the latter by a lead-wire.

The piezoelectric ignition switch 10 is also attached between the pressurized gas injecting entrance 12 and the gas discharge lever 4. A push-button b for the piezoelectric ignition switch projects outwardly from the hollow circular plate 1. The pressurized gas injecting entrance 12, the gas discharge lever 4 and the gas discharge control lever 5 project outwardly from the plate 1 so that they are able to be operated respectively from the exterior of the hollow circular plate 1.

The upper cover B is formed like a trivet to safely support the relatively heavy weight of a cooker.

This known portable cooking gas stove, however, has some disadvantages in its exterior view, operation and effect even if it is sufficient in weight, price heat capacity, etc. Firstly, the rate of air intake in the air intake support 7 cannot be regulated because the gas combustion nozzle n and gas introducing pipe 13 for the gas combustion means C is, respectively, fixed opposite both wall of the support, and consequently the heat capacity cannot be controlled whenever desired. Secondly, the pressurized gas fuel cannot be vaporized efficiently until is has reached the gas combustion means C due to a short gas flow in the gas fuel discharge control means D, and the flame tends to be momentarily interrupted in combustion. Accordingly, the short gas flow creates a decrease heating capacity and the bottom plate 14 of the hollow circular plate 1 tends to become sticky by unvaporized gas. Thirdly, the exterior view of the portable cooking gas stove A is not ornamentally attractive and the many projections, through the side wall of the hollow circular plate 1, such as the gas discharge control lever 5, gas discharge lever 4, switch button of the piezoelectric ignition switch 10 and injecting entrance 12, affects easy usage and decreases aesthetic consciousness.

Figure 3:
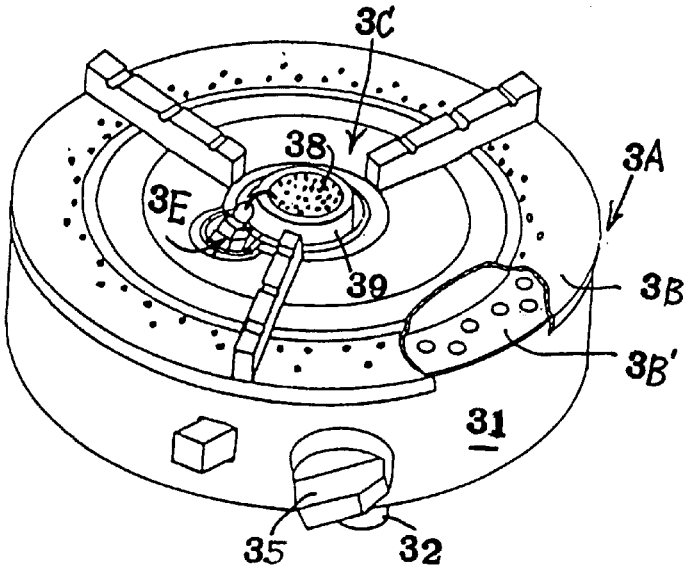
FIG. 3 is a perspective view of a light-weight portable cooking gas stove according to an embodiment of the invention.
Figure 4:
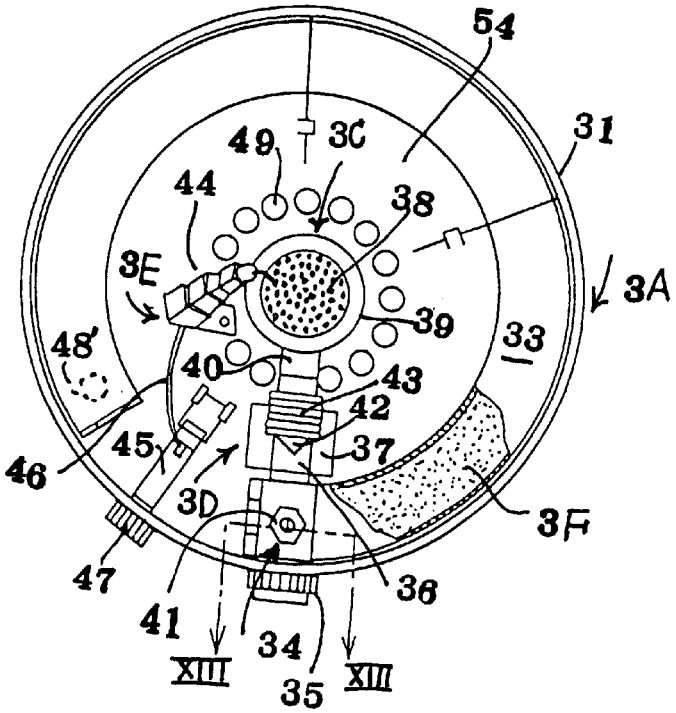
FIG. 4 is a plan view of the portable cooking gas stove of FIG. 3.

One embodiment of the present invention overcomes the above disadvantages is shown in FIGS. 3 and 4. The embodiment of FIGS. 3 and 4 is a light-weight portable cooking gas stove 3A having a plurality of supporting legs 32 and comprises a hollow circular plate 31 provided with a circular pipe cylinder 33 covered inwardly with a filter 3F such as a porous plastic material. The stove 3A further comprises a central gas combustion means 3C, including a gas introducing pipe 40, a gas discharge control means 3D comprising a gas discharge valve means 34 and a control 35 therefor at one end of the circular pipe cylinder 33. The stove 3A further comprises a piezoelectric ignition means 3E comprising an electrical lead wire 46 connecting a piezoelectric ignition plug 44 and a piezoelectric ignition switch 45, a push-button for the piezoelectric switch 45 and an upper double cover 3B, 3B' forming a trivet.

The hollow circular plate 31 is substantially the same as the plate 1 in FIGS. 1 and 2, except for systematic geometrical through holes 49 and an air intake hole 37 on a bottom plate 54 and systematic geometrical through holes on a side wall, and decreased through holes on the side wall for the gas discharge control means 3D and the piezoelectric ignition means 3E.

The circular pipe gas cylinder 33 is provided with the gas discharge valve means 34 at one end and a gas injecting entrance 48 or 48' at an either end thereunder for supply of gas fuel from a cassette gas cylinder, and installed alongside the inner circumference of a bottom of the hollow circulars plate 1, as in FIGS. 1 and 2.

The central gas combustion means 3C comprises a ceramic crater 38, same as the crater 8 in FIGS. 1 and 2, supported on a support ring 39. The gas introducing pipe 40 is connected with the ceramic circular crater 38 and a gas discharge pipe 36 of the gas discharge control means 3D.

The gas discharge control means 3D, which connects with the central gas combustion means 3C and the circular pipe gas cylinder 33, consists of the gas discharge valve means 34, provided with a secondary gas regulating means 41, like a bolt, and a gas discharge pipe 36, which provides an air intake hole 42 and a coil spring 43 thereon.

Figure 8:
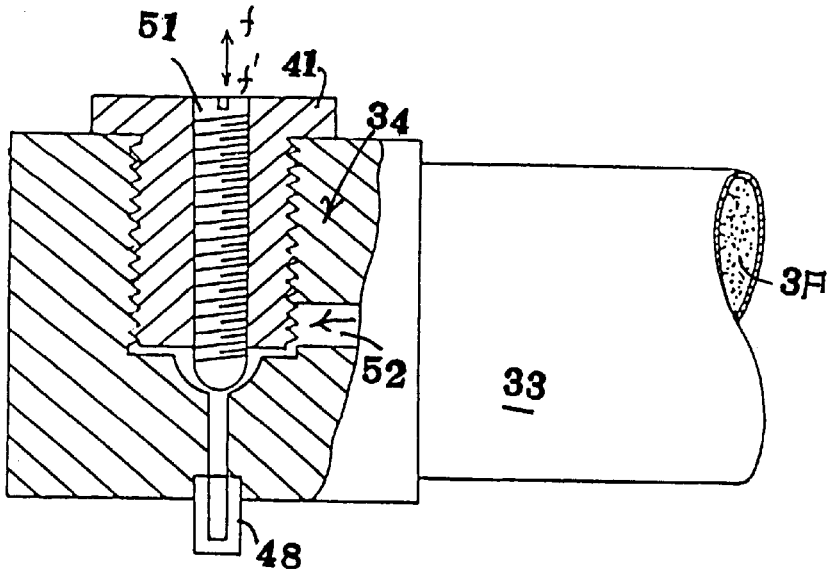
FIG. 8 is a partial sectional view along line XIII—XIII in FIG. 4.

The secondary gas regulating means 41 is formed as a double bolt in which a smaller bolt 51 is removable along an arrow f or f' inside or outside of the large bolt to selectively control through opening 52 the gas flow discharged from the circular pipe gas cylinder 33, as shown in FIG. 8.

The gas discharge pipe 36 provided for the air intake hole 42 and coil spring 43 thereon can control the air intake rate which affects the heating capacity together with a gas supply rate from the discharge valve means 34, by sliding or elongating the coil spring 43, due to increasing or decreasing of an open space of the hole 42.

The piezoelectric ignition means 3E functions substantially the same as in FIGS. 1 and 2 so as to ignite the discharge gas fuel on the ceramic circular crater 38, except that the piezoelectric ignition means 3E is installed in a position to a left side of the crater 38.

Figure 5:
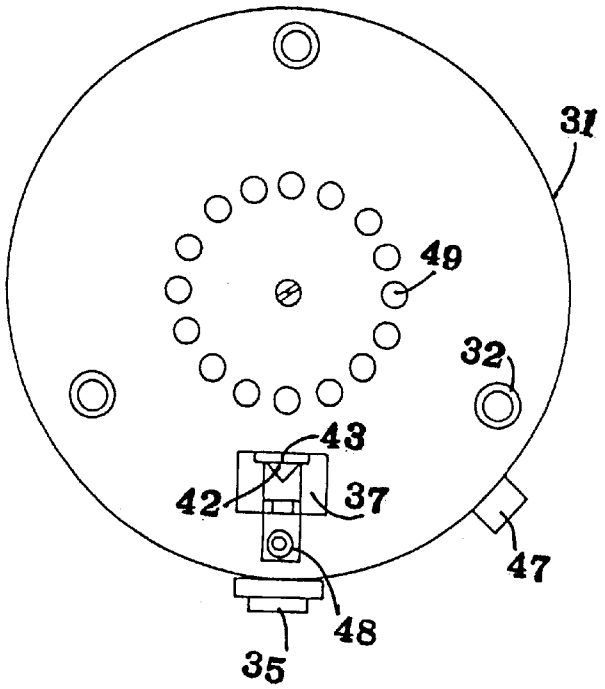
FIG. 5 is a bottom view of the portable cooking gas stove of FIG. 3.
Figure 6:
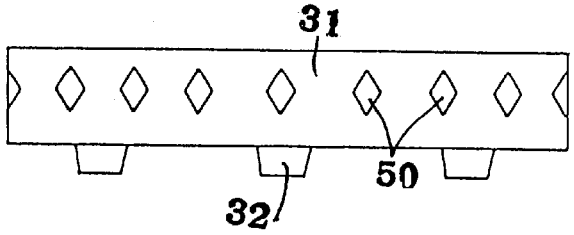
FIG. 6 is a rear view of the portable cooking gas stove of FIG. 3.
Figure 7:
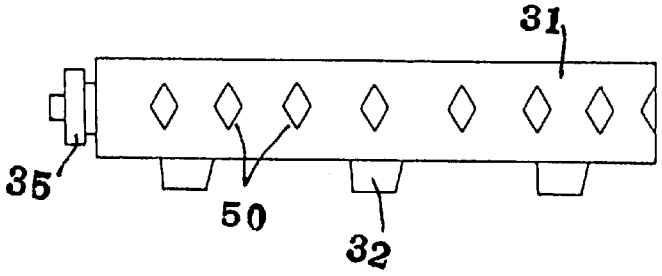
FIG. 7 is a side view of the portable cooking gas stove of FIG. 3

The hollow circular plate 31 may be provided with systematic geometrical through holes 49 or 50, such as circular or lozenge shape through holes, circularly continued on bottom plate 54 or on a side wall of plate 31 as shown in FIGS. 5, 6, and 7.

Minimum projections outwardly through the side wall of the hollow circular plate 31, such as push-button 47 of the piezoelectric ignition switch 45 and a switch button 35 of the gas discharge valve portion, make the exterior view of the hollow circular plate clear and neat and makes easy operation of the portable cooking gas stove 31 to be used by anybody and anywhere.

The double upper covers 3B and 3B' forms a trivet which not only prevents dirt on an inner bottom surface of the hollow circular plate 3, such as from boiling over from a cooker, but also supports a relative heavy weight cooker thereon.

Figure 9:
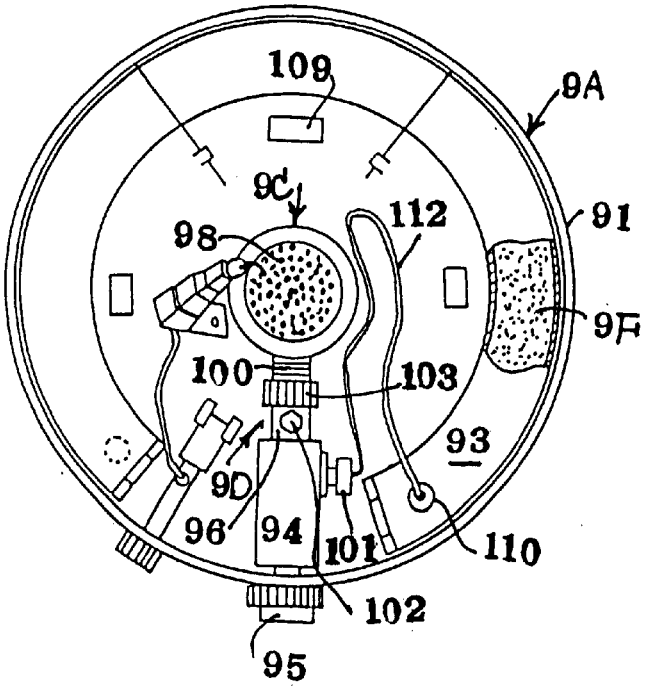
FIG. 9 is a plan view of another embodiment of a light-weight portable cooking gas stove.

FIG. 9 shows another embodiment of the light-weight portable cooking gas stove 9A which is substantially the same as shown in FIGS. 1 and 2 except for a gas discharge control means 9D. The gas discharge control means 9D comprises a gas discharge valve means 94 separated from a circular pipe gas cylinder 93 having inwardly a filter 9F. The gas discharge control means 9D is provided with a secondary gas regulating means 101, like a bolt thereon, a threaded gas discharge pipe 96 having an air intake hole 102 and a screw nut 103 combined thereon. The gas discharge control means 9D is connected with the gas discharge valve means 94 at one end and a gas combustion means 9C at the other end via a threaded portion 100 of the pipe 96. A long vinyl pipe 112 is connected with the secondary gas regulating means 101 at one end and gas outlet 110 of the circular pipe gas cylinder 93 at another end. A switch button 95 of the gas discharge valve means 94 projects outwardly through a side wall of the hollow circular plate 91.

The air intake rate into the gas fuel discharged from the circular pipe gas cylinder 93 is selectively regulated by removing the screw nut 103 on the threaded gas introducing pipe 96 and suitably closing or opening the air intake hole 102.

The rate of gas discharge from the circular pipe gas cylinder 93 to the gas combustion means 9C is controlled principally with a gas discharge valve (not shown) but the arrangement is performed by the secondary gas regulating means 101 is substantially as described in FIG. 8.

The long vinyl pipe 112 for gas discharge from the circular pipe gas cylinder 93 to the secondary gas regulating means 101 takes a roundabout path alongside the gas combustion means 9C thereby warming up the gas fuel passing through the pipe. The warmed gas fuel is evaporated efficiently by the air intake hole 102 and mixed suitably with the air taken into the screwed gas introducing pipe 96 through the hole 102. The gas fuel is then burned efficiently on the ceramic circular crater 98.

Figure 10:
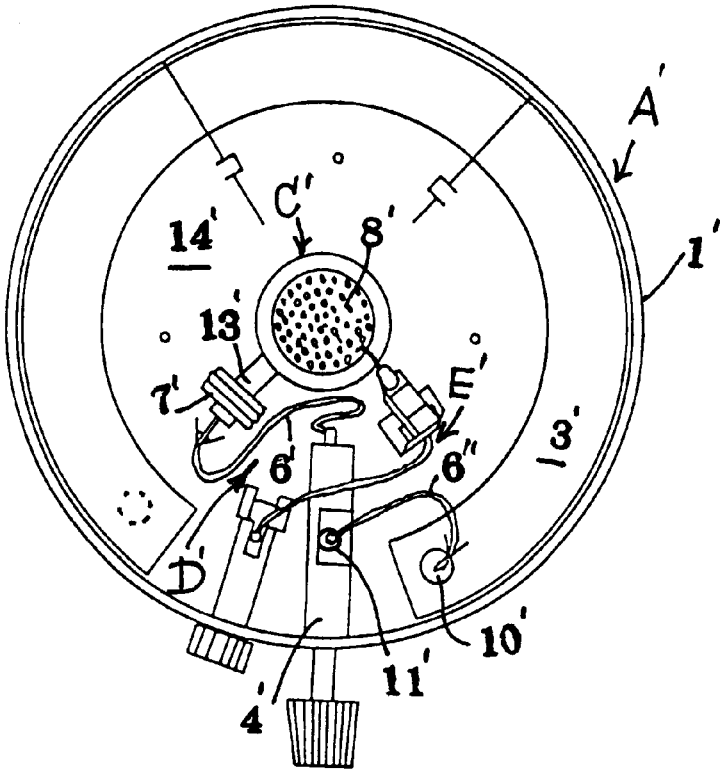
FIG. 10 is still another embodiment of a light-weight portable cooking gas stove

FIG. 10 shows still another embodiment A' for the present invention in which a gas discharge control means D' comprises a gas discharge valve means 4', a long vinyl pipe 6' and an air intake means as in FIG. 2. The gas discharge valve means 4' is connected with a gas outlet 10' of a circular pipe gas cylinder 3' disposed in hollow plate body 1' through a secondary gas discharge regulating means 11', substantially as shown in FIG. 4, and a short vinyl pipe 6". The fuel gas purified with a filter (not shown) in the circular pipe gas cylinder is warmed with waste heat from a ceramic circular crater 8', in a narrow space between an inner surface of a bottom plate 14' and an undersurface of double upper covers (not shown), so that it is evaporated efficiently by an air intake support 7'.

The long vinyl pipe 6', in this case, takes a roundabout path alongside the gas combustion means C', as described for long vinyl pipe 112 in FIG. 9. Evaporated pure gas fuel may be efficiently charged into the ceramic circular crater 8' through a gas introducing pipe 13', with a suitable rate of air from the air intake support 7', to make the gas fuel burn efficiently. A piezoelectric ignition means E' is substantially the same means as in FIG. 9, but is installed at a reverse position adjacent to the ceramic circular crater 8'.

Accordingly, the gas discharge control means 3D and 9D in the present invention, having respectively secondary gas regulating means 41 and 101, and air intake holes 42 and 102 which can control their open spaces, and thereby easily and properly adjust the gas fuel and air intake rates to be mixed in the gas discharge pipe 36 and 96, for an efficient combustion at the ceramic circular crater.

The long vinyl pipe 112 or 6', for the gas discharge from the circular pipe gas cylinder 93 or 3', in the gas discharge control means 9D or D' allows the gas fuel therein to evaporate sufficiently by the air intake hole 102 or support 7' and to burn efficiently in a shorter period than the known gas stove of FIGS. 1 and 2.

The gas discharge control means 3D, 9D or D' in the described portable cooking gas stove is simple and effective mechanically, and in operation can selectively control the efficient combustion of the stove. The exterior view of the stove is also more aesthetic and clear because of the minimum projections through the side wall of the hollow circular plate 31, 91 or 1' and the systematic geometrical through holes 49, 50.

While there has been described and pointed out the fundamental novel features of the invention as applied to preferred embodiments, it will be understood that various omissions and substitutions and changes in the form and details of the cooking gas stove disclosed and its operation may be made by those skilled in the art, without departing from the spirit of the invention. The invention, therefore, is limited only as indicated by scope of the following claims.

What is claimed is:

1. A cooking stove to be connected to a source of pressurized gas fuel comprising:

a hollow circular housing;

a circular pipe cylinder disposed within the housing and circumferentially adjacent an inner circumferential surface of the housing;

a filter disposed within the cylinder;

a ceramic gas combustion means having a crater with gas passage holes therein;

a gas discharge control means connected with the circular pipe cylinder and the ceramic gas combustion means;

a piezoelectric ignition means to ignite the gas fuel passing through the ceramic gas combustion means; and an upper cover on the hollow circular plate forming a trivet;

whereby the gas discharge control means is connected at one end of the circular gas cylinder and comprises a gas discharge valve means provided with a secondary gas regulating means, and a gas discharge pipe having an air intake means connecting with a gas introducing pipe for the gas combustion means.

2. The stove of claim 1 wherein the secondary gas regulating means comprises a first bolt and a second bolt, the second bolt threaded into the first bolt, the second bolt providing regulation of the gas discharge rate.

3. The stove of claim 1 wherein the air intake means on the gas discharge pipe comprises a hole and a coil spring on the gas discharge pipe for controlling the air intake rate through the hole of the coil spring by sliding of the coil spring or expansion or contraction of turns of the coil spring.

4. The stove of claim 1 wherein systematic geometrical through holes are arranged on a side wall and a bottom plate of the hollow circular plate.

5. The stove of claim 1 wherein a gas injecting entrance for the circular pipe cylinder is attached outwardly through a bottom plate of the hollow circular plate, at either end of the cylinder.

6. The stove of claim 1 wherein the upper cover is a double cover.

7. A cooking gas stove to be connected to a source of pressurized gas fuel comprising:

a hollow circular housing;

a circular pipe cylinder disposed within the housing circumferentially adjacent an inner circumferential surface of the housing;

a filter disposed within the cylinder;

a ceramic gas combustion means having a crater with gas passage holes;

a gas discharge control means connected with the circular gas cylinder;

a piezoelectric ignition means to ignite the gas fuel passing through the ceramic gas combustion means;

an upper cover on the hollow circular plate forming a trivet; and wherein the gas discharge control means is separated from the circular pipe cylinder and comprises a gas discharge valve means having a secondary gas regulating means which is connected with the circular pipe cylinder through a vinyl pipe and a gas discharge pipe having an air intake means connecting with a gas introducing pipe for the ceramic combustion means.

8. The stove of claim 7 wherein the secondary gas regulating means is a bolt having a central through hole and connected with the circular pipe cylinder through the vinyl pipe to regulate the fuel source.

9. The stove of claim 7 wherein the vinyl pipe from the circular pipe cylinder to the gas discharge valve means takes a roundabout path alongside the gas combustion means so that the gas fuel in the vinyl pipe is evaporated by waste heat of the ceramic combustion means.

10. The stove of claim 7 wherein the gas discharge pipe is threaded and the air intake means comprises a hole and a nut on the threaded gas discharge pipe.

11. A cooking stove to be connected to a source of pressurized gas fuel comprising:

a hollow circular housing;

a circular pipe cylinder disposed within the housing circumferentially adjacent an inner circumferential surface of the housing;

a filter disposed within the cylinder;

a ceramic gas combustion means having a crater with gas passage holes;

a gas discharge control means connected with the circular cylinder;

a piezoelectric ignition means to ignite the gas fuel passing through the ceramic combustion means; and a cover on the hollow circular plate forming a trivet, wherein the gas discharge control means is separated from the circular pipe cylinder and comprises a gas discharge valve means having a secondary gas regulating means which is connected with a gas outlet of the circular pipe cylinder through a first vinyl pipe and an air intake support connected with the gas discharge valve means and the gas combustion means through a second vinyl pipe longer than the first vinyl pipe and a gas introducing pipe.

12. The stove of claim 11 wherein the secondary gas regulating means is a bolt having a through hole and connected with the circular pipe cylinder through the first vinyl pipe to regulate the fuel supply.

13. The stove of claim 11 wherein the second vinyl pipe takes a roundabout path alongside the gas combustion means so that the gas fuel in the second vinyl pipe is evaporated by waste heat of the ceramic gas combustion means.

14. The stove of claim 11 wherein the air intake support is formed in a shape of a right angular conduit connecting the second vinyl pipe and the gas introducing pipe for the ceramic combustion means.

* * * * *